US007594564B2

(12) United States Patent
Siikonen et al.

(10) Patent No.: US 7,594,564 B2
(45) Date of Patent: Sep. 29, 2009

(54) ELEVATOR SYSTEM

(75) Inventors: Marja-Liisa Siikonen, Helsinki (FI); Janne Sorsa, Helsinki (FI); Jukka-Pekka Sarjanen, Vantaa (FI); Kim Bärlund, Lyngby Taarbaek (DK)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/167,103

(22) Filed: Jul. 2, 2008

(65) Prior Publication Data

US 2008/0302609 A1 Dec. 11, 2008

Related U.S. Application Data

(63) Continuation of application No. PCT/FI2007/000040, filed on Feb. 19, 2007.

(30) Foreign Application Priority Data

Mar. 3, 2006 (FI) ..... 20060215

(51) Int. Cl.
*B66B 1/20* (2006.01)

(52) U.S. Cl. ..... 187/384; 187/290; 187/392; 187/313

(58) Field of Classification Search ..... 187/247, 187/248, 290, 313, 316, 317, 380–388, 391–393
See application file for complete search history.

(56) References Cited

U.S. PATENT DOCUMENTS

| | | | | |
|---|---|---|---|---|
| 3,506,095 | A | 4/1970 | Weaver | |
| 4,023,146 | A | 5/1977 | Carroll | |
| 5,896,948 | A * | 4/1999 | Suur-Askola et al. | 187/290 |
| 6,000,505 | A | 12/1999 | Allen | |
| 6,315,081 | B1 | 11/2001 | Yeo | |
| 7,182,174 | B2 * | 2/2007 | Parrini et al. | 182/18 |
| 7,413,059 | B2 * | 8/2008 | Kawai | 187/384 |
| 7,461,723 | B2 * | 12/2008 | Kawai | 187/313 |
| 2007/0084673 | A1 * | 4/2007 | Smith et al. | 187/290 |
| 2008/0105499 | A1 * | 5/2008 | Tyni et al. | 187/382 |
| 2008/0202861 | A1 * | 8/2008 | Kawai | 187/384 |

(Continued)

FOREIGN PATENT DOCUMENTS

| | | | |
|---|---|---|---|
| EP | 1433735 | A1 | 6/2004 |

(Continued)

*Primary Examiner*—Jonathan Salata
(74) *Attorney, Agent, or Firm*—Birch, Stewart, Kolasch & Birch, LLP

(57) ABSTRACT

The present invention discloses a method, a system and a computer program for the effective evacuation of a building in an emergency, in which at least one elevator can be used as an evacuation aid. In the method the group control of the elevators monitors the numbers of people on the different floors of the building. The floor on which it is assumed are most people is set at each moment of monitoring for a greater priority in an evacuation situation. Taking into account the limited supply power a free elevator car is directed to the floor of the greatest priority, at which the elevator is filled. The full elevator is directed without stopping to the exit floor of the building. The system monitors by means of detectors the safety of the different parts of the building and directs people if necessary to a safe evacuation location to wait for an elevator. A so-called Traffic Forecaster can be used as an aid in defining the priorities.

52 Claims, 4 Drawing Sheets

U.S. PATENT DOCUMENTS

Figure 1:
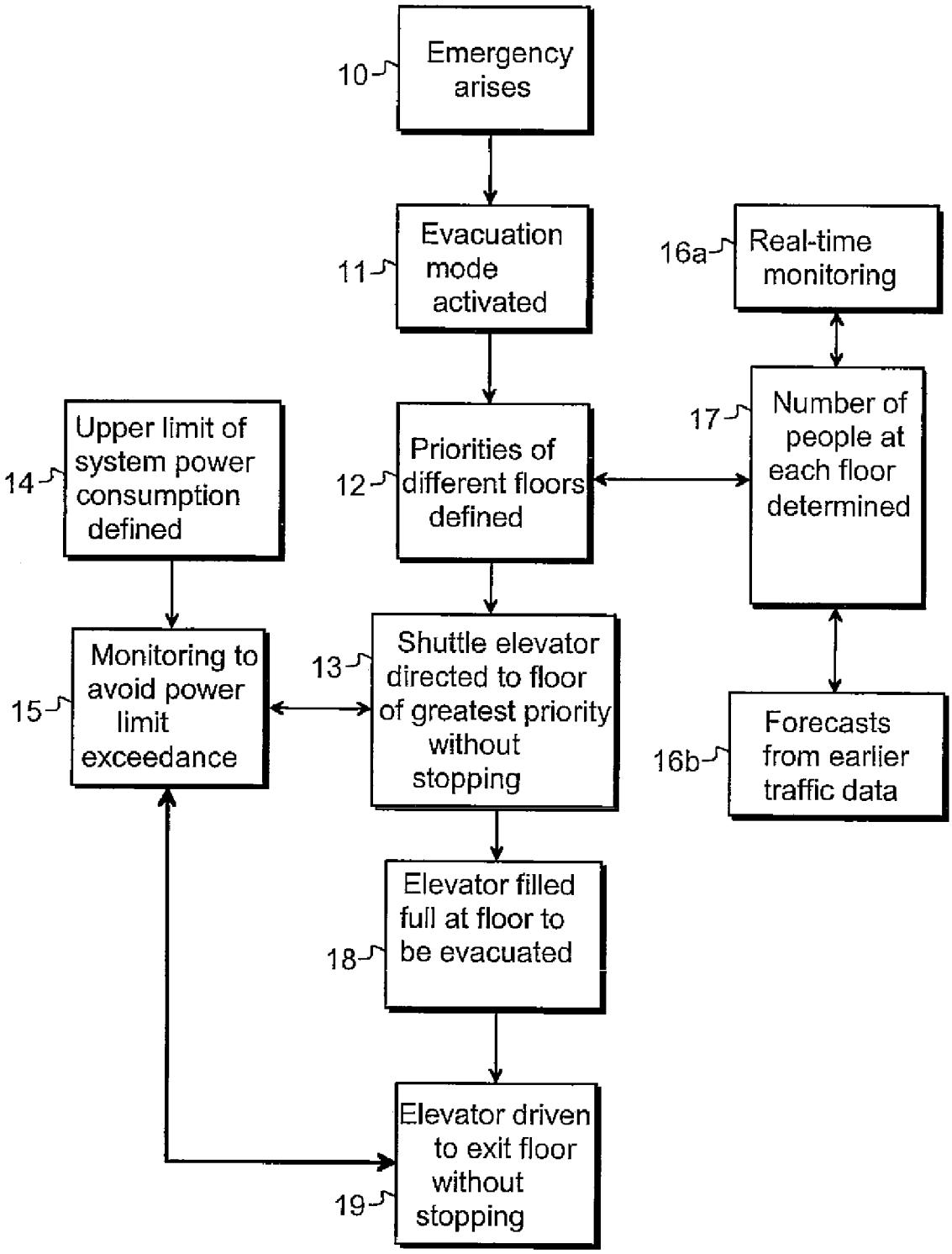

2008/0302609 A1* 12/2008 Siikonen et al. ..... 187/247

FOREIGN PATENT DOCUMENTS

| | | | |
|---|---|---|---|
| FI | 99109 | B | 5/1996 |
| FI | 20030614 | A | 10/2004 |
| JP | 8-333067 | A | 12/1996 |
| JP | 2003-146550 | A | 5/2003 |
| WO | WO-96/16892 | A1 | 6/1996 |
| WO | WO-2006/120283 | A1 | 11/2006 |
| WO | WO-2007/099198 | A1 | 9/2007 |

* cited by examiner

ELEVATOR SYSTEM

This application is a Continuation of copending PCT International Application No. PCT/FI2007/000040 filed on Feb. 19, 2007, which designated the United States, and on which priority is claimed under 35 U.S.C. § 120. This application also claims priority under 35 U.S.C. § 119(a) on Patent Application No(s). 20060215 filed in Finland on Mar. 3, 2006. The entire contents of each of the above documents is hereby incorporated by reference.

FIELD OF THE INVENTION

The present invention relates to elevator systems and especially to the control of elevators in a situation in which a building is evacuated with the aid of the elevators and in which the elevator system is dependent on an emergency power source.

BACKGROUND OF THE INVENTION

The allocation of calls given by elevator users to the different elevators of the elevator system is one of the basic tasks of the control of the system. The purpose of allocation is to give calls for the elevator cars to serve such that one of the desired performance indicators describing the operating ability of the elevator system is as good as possible. Conventionally the most commonly used performance indicators are e.g. passenger waiting times and travel times. Typically averages are calculated from these times and their distributions are established. In this context the term 'calls' is used to refer generally to all calls given—i.e. both the calls given with the up-down buttons situated on landings and the destination floor calls given in the elevator cars. The former are landing calls and the latter are car calls. In addition, calls can be calls given by call-issuing devices according to the so-called destination control method. In the destination control method the elevator user gives his destination floor to the system data with the call device already in the elevator lobby and in this case there is no need to give a separate call in the elevator car.

There are many types of call allocation methods and each elevator manufacturer has its own methods for implementing efficient call allocation that satisfies the elevator user. Each method, of course, includes numerous specific parameters that have the purpose of affecting the operation of the method. The control can be arranged such that e.g. the most suitable set of parameters for each situation are taken into use in different traffic situations. This is to give the elevator system the opportunity to adapt its operation to be the most suitable in respect of the prevailing traffic situation. A traffic situation can be e.g. a peak-hour situation, when the system registers a lot of simultaneous landing calls or destination calls.

One effective prior-art allocation method for elevators is the use of genetic algorithms especially in systems containing a number of elevators. Genetic algorithms are described in e.g. Finnish patent publication FI112856B. Genetic algorithms do not absolutely guarantee finding the most optimal value, but results achieved in practical applications are very close to it.

If an exceptional incident occurs or a threatening situation exists in a building, which can pose a danger to the users of the building, it is important to enable a safe exit of the users from the building. This kind of serious exceptional incident can be e.g. a fire, an earthquake, a bomb threat or similar type of event, which is of danger to the people in the building. An evacuation order can be given for the building after detecting an exceptional incident, either for certain floors of the building or for the entire building. The transport systems located in the building, such as elevators, are in this case placed in an important role.

Generally all use of an elevator in the event of fire is separately prohibited. This is because a fire can seriously damage an elevator system, in which case elevators are no longer safe to use for evacuating people to the exit floor of the building. It is possible that the elevator stops working during an elevator run, in which case the elevator car may stop between floors leaving the elevator passengers trapped. In addition, a fire or smoke may spread strongly, especially along the elevator shaft, in which case the elevator is no longer a safe place owing to the lack of oxygen or the heat. Also the extinguishing water used for extinguishing fires may damage the electrical parts of the system e.g. by causing short-circuits in the electronics parts of the system.

Additionally in the event of a fire it is not sensible to direct the elevator car to, and then open the doors to, a floor on which the fire has progressed to an advanced stage. In this case the safety of the people already traveling in the elevator is endangered and the time needed for evacuation becomes longer, if in addition it can be assumed that people have been evacuated from this kind of floor earlier.

On the other hand, if the elevator system or a part of it is constructed to be such that it withstands heat well by protecting the elevator shafts and elevator machines with suitable structures, the elevator system can very well be a feasible additional aid in the evacuation of the building. In high-rise buildings this is especially prominent, because the safe evacuation of a large number of people along the stairs and out of the building is extremely slow. If the elevators can be safely and reasonably controlled during an emergency, the evacuation time can be substantially shortened. It follows from the above that travel of the elevators in emergencies must be controlled in accordance with a special evacuation mode.

Additionally, when considering the energy requirement of an elevator system it is important to take into account a situation in which the electricity supply for some reason is unexpectedly disconnected. When the normal electricity supply disconnects, the emergency generator of the building should start, if this type of generator is available to the elevators. Emergency power is not normally sufficient for the needs of the whole elevator group (if it is a case of a large elevator group), but instead Emergency Power Drive (EPD) of the elevators is conventionally implemented such that an elevator or elevators is/are pre-selected, which serve passengers during emergency power use caused by an exceptional situation.

In the event of a power outage an elevator containing passengers can stop between floors. In this case in prior art when the emergency generator has started the elevator group control returns the elevators one at a time in a pre-defined sequence to the homing floor (generally the lobby), at which the passengers can exit the elevator. After this homing phase the aforementioned pre-defined elevators are placed into normal service (as "full service elevators"). The number of these type of elevators placed into service depends on the power and power requirement of the emergency generator, which the elevators in the worst case will require. The loading of the elevator car and the counterweight are almost always unbalanced and moving the elevator in the so-called light direction (empty car upwards, full car downwards) requires less power than in the so-called heavy direction (empty car downwards, full car upwards). Modern elevator drives can even return the latent potential energy of passengers back to the electricity network—i.e. function as a generator when driving in the light direction or when the elevators decelerate.

In modern skyscrapers, which are completed and which will be completed in the near future especially in South-East Asia, there may be up to 200 people on one floor if the building is in office use. Studies have shown that in buildings of about twelve stories and higher, elevators function more efficiently in emptying the building than stairs, if these two are alternatives to each other.

In the USA smoke detectors and heat detectors are used in elevator shafts, by means of which a fire that has ignited in the elevator shaft or its proximity can be detected. Use of the elevators is permitted in emergencies if the detectors have not triggered.

Publication U.S. Pat. No. 6,000,505 presents an appliance, with which a multiple level building can be evacuated during a fire incident using the elevator system. The appliance includes smoke detectors positioned on different floors. Elevator traffic is directed from the floors to be evacuated to the exit floor such that the doors of the elevator do not open on those floors on which a smoke detector detects smoke. The appliance also includes an emergency power source. One problem in the arrangement according to publication U.S. Pat. No. 6,000,505 is that the appliance is not able to forecast its own endurance and a consequence of this can be that the elevator could be performing an evacuation task at exactly the moment some critical component fails owing to e.g. strong heat in a fire incident.

A problem of prior art is that an effective evacuation method in a building in which both the stairways and the elevators can be used for evacuation has not previously been presented. Neither have all the parameters, with which the speed of evacuation can be influenced, been taken into account in prior art technology.

PURPOSE OF THE INVENTION

The purpose of the present invention is to present an effective control method for the elevators of an elevator system in a situation in which a building is being either partially or totally evacuated, and in which also the electrical power available for using of the elevators is limited. The purpose is thus to maximize the number of people be saved.

SUMMARY OF THE INVENTION

The method according to the invention is characterized by what is disclosed in the characterization part of claim 1. The system according to the invention is characterized by what is disclosed in the characterization part of claim 18. The computer program according to the invention is characterized by what is disclosed in the characterization part of claim 35. Other embodiments of the invention are characterized by what is disclosed in the other claims. Some inventive embodiments are also presented in the drawings in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the scope of the basic inventive concept in conjunction with other embodiments.

The present invention discloses a method of controlling elevators for evacuating people from a building, in which the power available for the elevator system to use is smaller than in normal operating mode. The characteristics of the invention are that the numbers of people to be moved between different floors of the building are monitored in it. Furthermore the floor of the greatest priority is defined in the invention. After this a free elevator is driven without stopping to the defined floor if the starting of the elevator does not cause exceedance of the power available for use. A further characteristic is that a filled elevator at the defined floor is driven to the exit floor of the building if the starting of the elevator still does not cause exceedance of the power available for use.

In one embodiment of the present invention the numbers of people to be moved in the building are calculated by means of car load weighing devices, call data, detectors situated in the door openings of the elevators and/or the stairways. On the basis of this data, i.e. the flows of people, the numbers of people on the different floors of the building are estimated.

In one embodiment of the present invention the greatest priority is given to the floor on which most people are estimated to be at the moment of examination.

In one embodiment of the present invention the greatest priority is given to the floor on which most calls have been given at the moment of examination.

In one embodiment of the present invention the elevator to be driven is a so-called shuttle elevator, which travels between the exit floor of the building and the upper lobby floor without stopping at floors between these.

In one embodiment of the present invention the elevator to be driven is a so-called local elevator, which serves all the floors in the desired floor-to-floor zone.

In one embodiment of the present invention the elevator becomes full of people to be evacuated at the floor of the greatest priority and after this the elevator car is directed to the exit floor without stopping.

In one embodiment of the present invention the elevator is only partially filled at the floor of the greatest priority. After this the elevator can be directed to at least one intermediate floor, which is situated between the floor of the greatest priority and the exit floor. At the intermediate floor the elevator fills with people to be evacuated and after this the elevator is directed without stopping to the exit floor.

In one embodiment of the present invention priorities are defined for different floors according to how many people are estimated to be awaiting evacuation at each floor. After this free elevators are allocated to those floors that have the highest priority such that the input power of the system is as much as possible without exceeding the upper limit of power consumption available for use by the elevators.

In one embodiment of the present invention the smoke concentration and the temperature of the stairways and the elevator shafts of the building are monitored. Based on the monitoring data the elevator lobbies, elevators, stairways or other areas of the building that are dangerous to people, in which the smoke concentration or the temperature has exceeded the set threshold value, can be defined. After this people are directed to the desired elevator lobby, elevator, other floor, direction or stairway, which has not been defined as dangerous. Finally the aforementioned free elevator is directed to the floor to which the people have been directed.

In one embodiment of the present invention the greatest priority is given to the floor at which the set threshold value is exceeded the most.

In one embodiment of the present invention a filled elevator at a defined floor is driven without stopping to an alternative exit floor, if the main exit floor of the building has been defined as dangerous and the alternative exit floor has been defined as non-dangerous.

In one embodiment of the present invention the evacuation mode of the elevator system is activated when the set threshold value is exceeded.

In one embodiment of the present invention the evacuation mode of the elevator system is activated manually.

In one embodiment of the present invention based on the calculated quantities of traffic a traffic profile is created for each day of the week with the desired time windows, in which the traffic profile contains data about the number of users of the elevators, travelators and stairways. Based on the traffic profile the traffic situation and the numbers of people on the different floors of the building can be forecast.

In one embodiment of the present invention the elevators are directed to the floors to be evacuated in the sequence of priority such that when one elevator stops at a floor another elevator starts moving.

In one embodiment of the present invention a genetic algorithm is used in defining the routing of the elevators.

The inventive concept of the present invention also includes a similar system, which implements different applications of the method disclosed. The system comprises a monitoring unit for monitoring the numbers of people to be moved between the different floors of the building and group control of the elevators for defining the floor of the greatest priority. Furthermore the group control of the elevators drives a free elevator to the defined floor without stopping if the starting of the elevator does not cause an exceedance of the power available for use. After this the group control of the elevators drives the filled elevator at the defined floor to the exit floor of the building if the starting of the elevator does not cause exceedance of the power available for use.

In one embodiment of the invention the system includes smoke detectors and temperature detectors for monitoring the smoke concentration and the temperature of the stairways and elevator shafts of the building. In this case the evacuation management system defines the elevator lobbies, elevators, stairways or other areas of the building that are dangerous to people, in which the smoke concentration or the temperature has exceeded the set threshold value. The evacuation management system directs people to the desired elevator lobby, elevator, other floor, direction or stairway, which is not defined as dangerous. After this the group control of the elevators directs the aforementioned free elevator to the floor to which the people have been directed.

In one embodiment of the invention the system includes a traffic forecaster unit, which creates a traffic profile on the basis of the calculated amounts of traffic for each day of the week with the desired time windows. The traffic profile contains data about the number of users of the elevators, travelators and stairways Based on the traffic profile the traffic forecaster unit can forecast the traffic situation and the numbers of people on the different floors of the building.

The inventive concept of the present invention also includes a computer program, which when running on a data processing device is arranged to perform the stages of the method presented above and their different applications.

An advantage of the present invention is that by means of the method the evacuation time of a person to be evacuated from especially a high-rise building can made shorter than can be guaranteed with e.g. only use of the stairways. Likewise safety can be improved with the method in a situation in which people move quickly towards the evacuating elevator in an emergency. Another advantage of the present invention is also that when a power limit is in force the elevator system nevertheless achieves surprisingly good performance.

LIST OF FIGURES

Figure 2A:
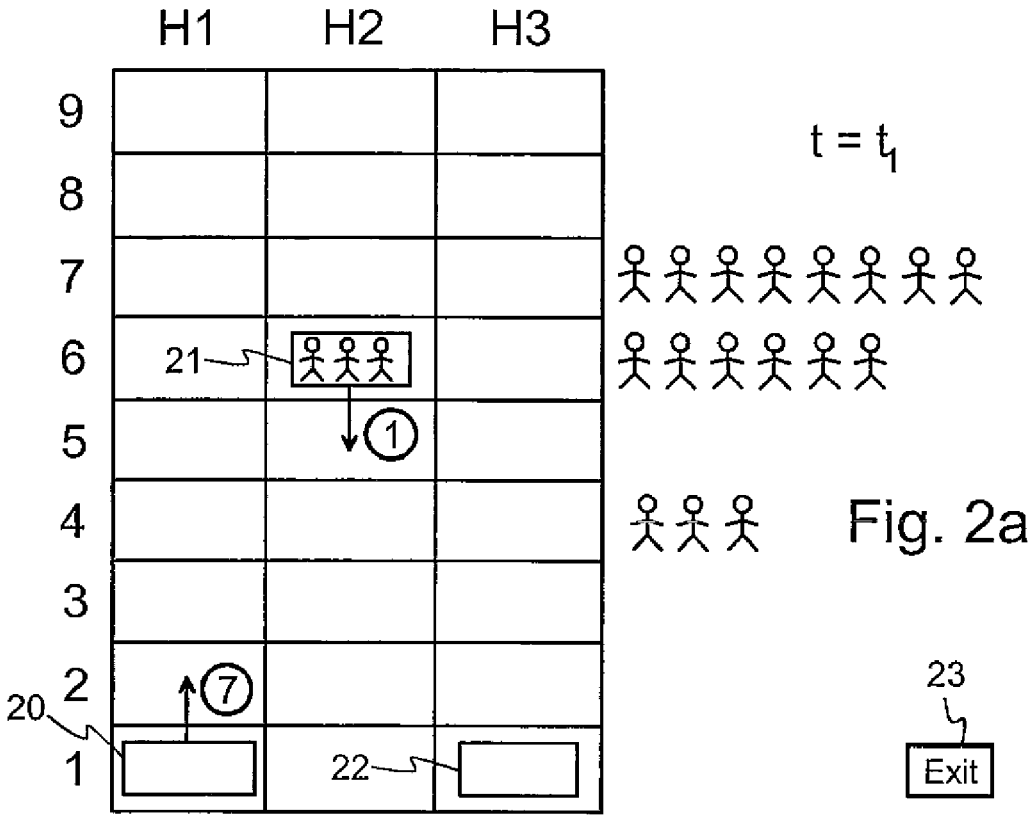
Figure 2B:
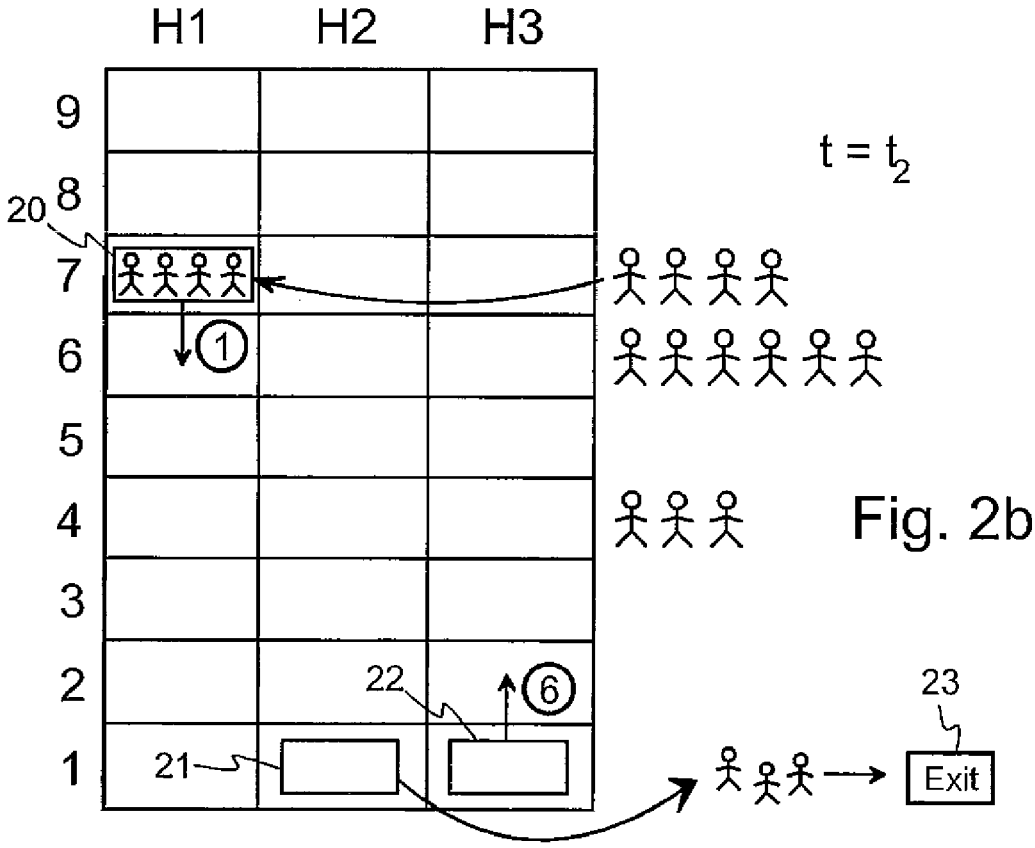
Figure 2C:
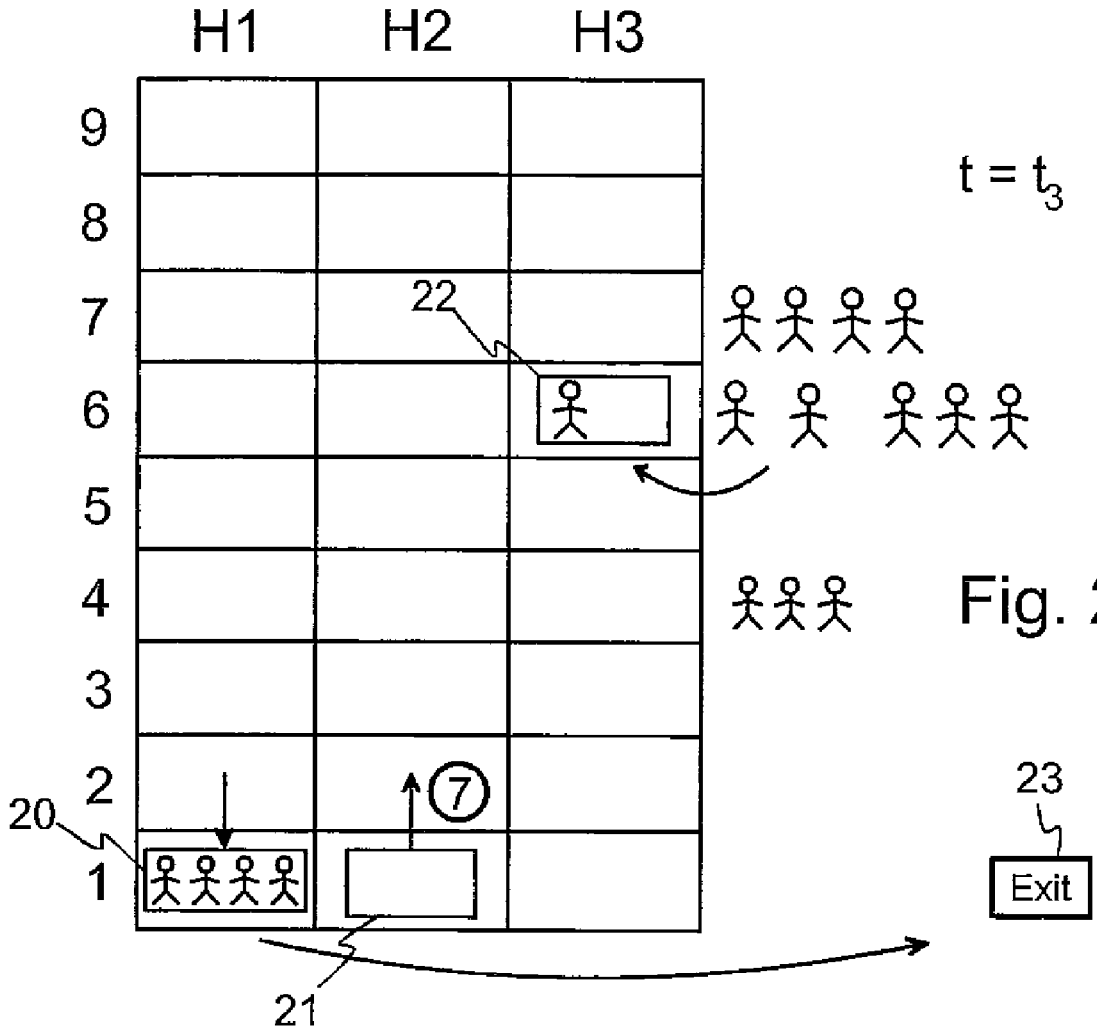
Figure 3:
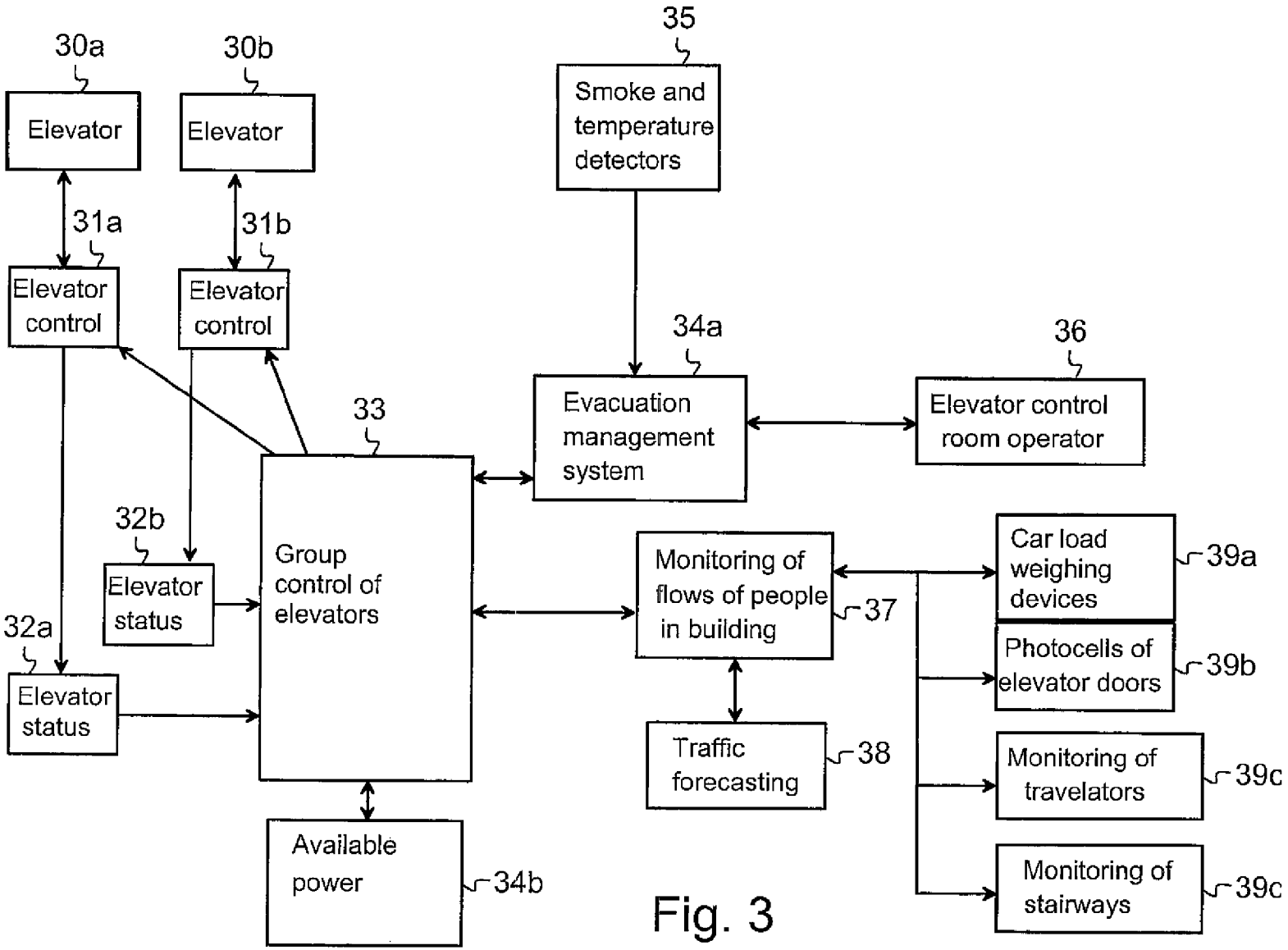

FIG. 1 presents a flowchart relating to the present invention, which describes the elevator control method in connection with an evacuation situation, FIGS. 2*a*-2*c* present an example of a way with which people are evacuated in the present invention in a system of three elevators, and FIG. 3 presents the equipment needed by the embodiment in an elevator system according to the present invention.

DETAILED DESCRIPTION OF THE INVENTION

The present invention discloses a method for effective evacuation of a building using the elevators of the building. It can be assumed that the building contains elevators and stairways as well as travelators, or only some of these types of conveyance. If the building to be monitored is high-rise, it can contain both shuttle elevators and so-called local elevators. Shuttle elevators are intended for longer floor-to-floor distances in a high-rise building such that a shuttle elevator serves only e.g. the upper floors of a high-rise building. In this case from the lobby floor it is only possible to go to the desired upper floor and vice versa. This enables fast elevator service on the upper floors of a high-rise building.

It must be noted that shuttle elevators consume more power than so-called conventional elevators.

In addition to shuttle elevators, so-called local elevators are needed, with which the other floors of a high-rise building are served. In this case intermediate stops are permitted for the local elevators and they serve in a shorter floor-to-floor zone. The elevator system of Petronas Tower in Kuala Lumpur, Malaysia, can be considered an example. This building has 88 floors. The elevator system of Petronas Tower comprises 35 elevators intended for passenger traffic, of which 29 are double-car elevators. This means that two elevator cars connected one on top of the other are disposed in the same elevator shaft. Double-car shuttle elevators are disposed in the building such that they convey people from the lobby directly to floors 41 and 42, which function as so-called upper lobby floors. The shuttle elevator does not serve other floors, but the local elevator groups serve the desired floor-to-floor zones. For example the elevator group B serves from the lobby to floors 23-37 and vice versa. On the one hand the elevator groups D and E, which leave from the upper lobby floors, serve the upper floors of the building. On the other hand, owing to the safety regulations, the building must contain an elevator with which all floors can be reached from the lobby.

In the Petronas Tower example this elevator is for the use of rescue personnel and management. The name fireman's elevator can also be used for this kind of elevator.

The method according to the present invention is described by way of an example as a flowchart in FIG. 1. The situation according to FIG. 1 is an emergency, which requires at least partial evacuation of the building. In the example it is assumed, however, the elevators can be used as an evacuation aid alongside the stairways. The starting point of the method of the invention can be regarded as being an emergency or the threat of it occurring in the building 10. The emergency can be e.g. a fire breaking out in a part of the building, an approaching tropical storm, a bomb threat or an act of terrorism. In the case of fire the procedure typically has been that the elevators may not be used at all, and thus the people to be evacuated have been directed to walk along the stairs towards the exit floor. In the present invention it is explicitly with the elevators that additional capacity is obtained for effective emptying of the building and a consequence of an emergency occurring is activation of evacuation mode 11. This activation can happen automatically, when the temperature detectors or smoke detectors situated in the building detect that a fire has started. On the other hand evacuation mode can be activated, for instance by the lobby duty officer, an external operator or an authority. In this case the operator can be e.g. an employee in the control room of the elevator system.

In the method according to the present invention traffic measurement that is in itself prior art and the forecasting of expected traffic amounts based on it can be utilized. The abbreviation TF (standing for the English term Traffic Forecast) can be used to refer to this system. In TF changes in the car load are detected such that the increase or decrease in mass occurring step by step in the car are measured. With stepped monitoring at least in principle the number of people moving into the car and leaving the car can be detected at each stop regardless of the weight of one passenger. Also call data can be used by the TF system. Instead of, or in addition to, the car load weighing device, photocells can be used in the doors of the elevators and/or in the stairways, and thus the exact number of people passing into the elevator car and out of it can be exactly determined, if it can be assumed that only one person at a time passes through the door opening. The traffic amounts for entering traffic, exiting traffic and interfloor traffic are determined and 15 minutes is selected as the length of one monitored time window. The monitoring is performed e.g. in an office building for the relevant time span (7.00 am-18.00 pm), but for a residential building round-the-clock distribution of traffic can be monitored. The monitoring is performed for all the days of the week. A traffic profile for one week is obtained from the measured data. The traffic profiles of previous weeks can be taken into account such that the week just measured is given a weighting of 0.5 and the sum profile calculated from all the previous measured weeks is also weighted with a factor of 0.5. In this case the history data is included, but the newest measuring data receives a relatively larger weighting. Thus in a certain way this is a learning system. The sum profile obtained as a result gives the typical expected traffic volume data at a certain time.

A problem with TF is that it is difficult to define the point in time when one floor or the whole building is totally empty. This problem occurs especially in residential buildings, hotels and publishing houses, in which it is not possible to e.g. assume, as it is for an office building, that at night the building is totally empty.

With the real-time monitoring 16*a* described above, information can be given to the group control about the movements of people. When in addition the system has at some time received initiation data, e.g. about the point of time when the building is totally empty, TF has a good estimate of the numbers of people 17 on each floor at the desired point of time.

On the other hand in the present invention Traffic Forecaster is able to predict the traffic situation 16*b* at the desired point of time and on the desired day of the week. Thus in this context it is assumed that the traffic and the number of people detected on each floor at a certain point of time and on a certain day of the week do not vary greatly. In this case the forecast given by TF can be trusted. By means of the forecasts the number of people 17 on each floor at any time can likewise be determined.

Next priorities with regard to an evacuation situation are given to the floors of the building on the basis of its degree of fullness at that moment. In the situation it is assumed that the floors to be evacuated must be totally emptied, and these floors are placed in a sequence of importance according to the numbers of people located on them. This is a very straightforward way to set priorities for floors, but especially when using shuttle elevators it is important to get the elevator car as full as possible for each downward drive.

A problem may occur in the situation in which when an elevator allocated to a floor that has a larger number of people arrives at the floor, the number of people waiting in the elevator lobby is not as large as was deduced in block 17. It can nevertheless be considered that evacuation is activated when a real emergency occurs, in which case the number of people waiting for the elevator in the elevator lobby correlates very well with the floor population measured or forecast by the system. This assumption of course holds true when the elevator lobby is not too dangerous a place for people to be.

In the present invention monitoring of the landing calls or so-called destination calls is not necessarily needed when operating in evacuation mode. However when defining the priorities it is possible to monitor e.g. the floors on which a landing call button has been pressed or in a destination system it is possible to monitor the number of destination calls given per floor.

In an emergency a disruption or disconnection of the electricity power supply to the elevator system may also occur. A disconnected electrical power supply can be replaced by switching the emergency power source on, if there is one available. A generator operating in the building can function as emergency power. An emergency power supply typically has some maximum power, which limits the power available for the elevators to use. The power consumption of the system is also limited by the magnitude of the main fuse of the system. The fuse or the capacity of the emergency power source thus sets the upper limit 14 for the instantaneous power consumption of the elevator system. Additionally, it must be taken into account that the energy of the emergency power source can be needed for maintaining other necessary functions also, in addition to the moving of elevators. This kind of function can be e.g. partial lighting of the building.

After this the group control of the elevators takes also the power consumption required by the route of the elevator in each route option of the elevators when it allocates elevators (e.g. by means of a genetic algorithm). The task of the group control is to make sure that a route is selected for each elevator such that the upper limit of power is not exceeded during travel along it. This monitoring and checking of the viability of route options is performed in block 15.

In practice the presence of an upper limit makes it so that the number of elevators moving simultaneously, especially in the so-called heavy direction, must be restricted. For example the conveyance of a relatively empty elevator downwards is heavy direction traffic. A consequence of the power limit is in practice often that as one elevator stops another elevator starts moving. The monitoring of power performed by the group control can be implemented such that first the power consumed by the elevators moving at the time is monitored. The system in addition knows how much power the starting of an empty elevator upwards from the lobby floor consumes. If the difference of the upper limit of power and the power consumed at the moment of inspection is at least the power required by the starting of one elevator, but less than the combined power required by the starting of two elevators, the group control gives permission for the allocation and the starting of one elevator towards the floor that is to be evacuated and is according to the greatest priority. The combined power consumed can be monitored at the desired intervals of time.

In the method according to the present invention it is preferably possible to be able to monitor also the flow of people moving in the stairways of the building. In this case the amount on each floor at any time can be determined much more accurately than by monitoring just the elevator traffic.

Further it is very preferable to use also stairs and travelators for evacuation alongside the elevators, if the building contains these. For example, by means of sensors situated in the door openings the system is able to determine how many people are still awaiting evacuation on each floor. Further it is preferred that the system is able to inform, e.g. by means of display panels, where it is best for people to move to so that the evacuation time can be made as short as possible and the evacuation itself made safe. On the other hand the safety status of the different parts of the building as well as of the elevators and the stairways (the desired floor, the desired elevator or the desired stairway) also affects the location to which they are to be directed. Directing people to the optimal location in an evacuation situation is of course linked also to the movement status of the elevators, the total power available for use, the gravity of the emergency and the specification of different parts of the building to which for safety reasons people may not be directed.

It is also a characteristic of the present invention that if the building contains so-called shuttle elevators, one of them is allocated to the floor with the greatest priority 13 such that the upper limit of power consumption is not exceeded as a consequence of the elevator starting. Control of the shuttle elevator to the evacuation floor is performed without stopping at intermediate floors, even though there are outstanding landing calls at them or on the basis of the monitoring 16 it can be assumed people are still on them. In this way the shortest possible service time to the floor of greatest priority is ensured. If the building does not contain shuttle elevators, any elevator at all of the elevator system that is available as a result of the allocation algorithm is allocated to the floor to be evacuated.

After the elevator arrives at the floor of the highest priority to be evacuated, the doors of the elevator open and people can move into the elevator car 18. The intent is to fill the elevator as full as possible. As people move into the elevator car the system keeps a record e.g. by means of the car load weighing device and/or the door sensors of the number of people that moved into the elevator car. The elevator closes its doors when the maximum load of the car is achieved or when all the people in the elevator lobby have moved into the car. After this the elevator drives without stopping to the exit floor 19 of the building such that the starting of the elevator and the elevator run itself do not in this case either cause an exceedance of the upper limit of power consumption. The doors of the elevator open and people are able to leave the building. The system however simultaneously monitors whether the exit floor is safe enough—i.e. whether the fire has spread a long way, or whether there is abundant smoke, in the lobby. In this case the system can direct the elevator to an alternative exit floor, if there is one, and if the alternative exit floor offers a generally safer escape route than the exit floor.

FIGS. 2*a*-2*c* present by way of an example the progress of flows of people in a situation in which evacuation of the building has been activated as a consequence of an emergency situation. The situations of the figures progresses in chronological order such that $t_1<t_2<t_3$. In the first situation (FIG. 2*a*) two elevator cars are situated at the lobby floor of the building, both stationary. One elevator is at floor six traveling downwards, carrying three people to be evacuated. In the elevator lobbies of the different floors of the building people are waiting for an elevator such that there are eight of them on the 7th floor, six on the 6th floor and three on the 4th floor. At the moment of examination $t=t_1$ the elevator H2 21 has been directed to the exit floor, i.e. the 1st floor. At the same time the group control in its monitoring of the movement of people in the building has concluded that there are most people on the 7th floor at that particular moment. A landing call button could have been pressed on floor 7, but that does not necessarily have to be the case. Because the number of people at each floor of the building is a relatively good estimate, the highest priority can be set with a great degree of probability for the floor at which in reality most people are waiting in the elevator lobby. At the moment $t=t_1$ the elevator H1 20 thus receives a control signal from the group control and starts moving towards floor 7.

In FIG. 2*b* the situation is examined at a slightly later moment in time $t=t_2$. At this moment of examination the elevator H1 20 has arrived at floor 7, the floor to be evacuated, and four people have moved into the elevator car H1. Because more cannot fit into the elevator, the rest of the people stay on the floor and wait. At the same time the elevator H2 21 on its journey downwards has now arrived at the lobby floor, where the three passengers who were riding in it are leaving the building (Exit). At the same time the system detects that the elevator H1 20 is leaving in the so-called light direction (full car downwards). In the example of FIG. 2*b* the system detects that the maximum power permitted by the emergency generator is not yet fully used (especially if energy can be returned for the system to use when traveling in the light direction). For this reason the group controller allows the elevator H3 22 to start towards floor 6 (at which there are most people waiting in the elevator lobby).

FIG. 2*c*, for its part, presents the situation in the building at the moment $t=t_3$. At this moment the elevator H1 20 has finished conveying passengers to floor 7, the ground floor, and the people are preparing to leave the elevator towards the exit. The elevator H3 22 meanwhile has arrived at floor 7, the floor to be evacuated, and is preparing to receive embarking passengers from the lobby of floor 7. At the same time as the elevators H1 20 and H3 22 stop, the group control concludes that power capacity is released and the group control therefore permits the elevator H2 21 to leave towards the upper floors. At the moment of examination floor 7 has received the highest priority, which is thus the target floor of the elevator H2 for evacuation. The control of the elevators continues on this principle until the building has been emptied or until the emergency has been e.g. cancelled (if it was a false alarm).

In the examples of FIGS. 2*a*-2*c* it must be noted that the stairways can also be used in evacuation. It is anyway natural for people to use stairs, because e.g. in the event of a fire people have traditionally been directed not to use elevators. In order for the group control to remain aware of the numbers of people in the building, it is useful in this connection to also monitor the doors leading to the stairways from each elevator lobby.

As another example a situation can be considered in which the elevator is not possible to be fill the elevator at the floor to be evacuated. The elevator thus contains more transport capacity than that of the passengers stepping into the elevator on the floor of the highest priority. In this case it is preferable to direct the elevator to an intermediate floor on the route of the evacuation run and fill the elevator car as full as possible at the intermediate floor. The full elevator car can after this drive without stopping to the lobby floor of the building or to an alternative exit floor.

FIG. 3 describes by way of an example the equipment relating to the present invention. One or more elevators 30*a*, 30*b* are disposed in the building, and this example describes two of them. Each elevator has a control block 31*a*, 31*b*, in which the most essential component is a motor that functions as the power source of the elevator car. From the viewpoint of the invention an essential part in respect of the operation of the algorithm is the group controller 33 of the elevators. It is there that the actual allocation of the elevators is handled, in other words the routings of the elevators are calculated such that the desired criteria are fulfilled (such as the average waiting time remaining below the desired value), and that the different operating modes are taken into account (such as evacuation mode being switched on). The group controller 33 needs information from the elevators 30*a*, 30*b* about the status 32*a*, 32*b* of each elevator. The status data contains both the position of the elevator and its state of motion as well as the stage of movement (constant speed, accelerating, decelerating). The group controller 33 of the elevator system is of course connected to the controller 31*a*, 31*b* of each elevator.

In the present invention an evacuation management system 34*a* is further needed, which supervises that the monitoring components located in the building are monitored and based on them activates different operating modes, if necessary, such as evacuation mode. The evacuation management system receives input signals not only from the smoke detectors and the temperature detectors 35 but also manual activation of evacuation mode is possible e.g. by the operator 36 of the elevator control room. Activation of evacuation mode can thus occur automatically or manually.

In addition the group control 33 of the elevators receives information about the available power 34*b* as its input data. This upper limit of power consumption can be determined directly from the power of the emergency power source in use or the upper limit can be determined such that all the other necessary functions of the building that need power, such as lighting, are taken into account in it. The available power 34*b* thus represents the power limit that the consumption of the elevator system cannot exceed at any time whatsoever.

A guide system for the users of the building can be connected to the evacuation management system 34*a*. It is useful if in the event of a fire people receive information about the location or the direction or the floor which they should endeavor to reach if e.g. it is not possible to direct an evacuation elevator to the floor on which they are currently located and also if the nearest stairway is not a safe emergency exit. In this case it is preferable to direct people to the desired stairway or to the desired elevator lobby containing operational elevators. The guide can be implemented e.g. with guide displays situated in the vicinity of the call buttons of the elevator lobby or with green LED displays situated above passageways (such as in the way emergency exits can be marked).

Monitoring of the people in the building is controlled by the equipment in block 37. The parts of the system monitoring the movements of people are the car load weighing device 39*a* in each elevator car, the photocells in the doors of the elevators 39*b* and in the doors of the stairways 39*d* as well as in other appropriate locations, and the sensors in the mouths of any travelators 39*c*. At least a good estimate of the numbers of people moving from one floor to another is obtained. On the other hand stepped monitoring of the change in the total mass of the car is possible by means of the car load weighing device 39*a*, if it can be assumed that only one person at a time passes out of the door of the elevator. Thus the change in the number of people in the car is determined from the number of these stairs describing the change.

The Traffic Forecaster (TF) 38 described above utilizes the traffic data that is already calculated for a so-called typical day. From this data the traffic volumes for the day of examination at the moment to be examined and also a good estimate e.g. of the numbers of people on the different floors of an office building at the moment of examination can be forecast. The Traffic Forecaster thus functions in close co-operation with the monitoring equipment 39*a*-39*d* via the control module 37 of the monitoring.

The equipment needed in the present invention can be made more protected with regard to safety aspects by constructing the shuttle elevators to be fireproof. It is very expensive to build fire protection in all the elevators of a very tall building, but when considering evacuation mode it is rational to better protect from fire the shuttle elevators and their elevator shafts in particular.

The invention is not limited solely to the embodiments described above, but instead many variations are possible within the scope of the inventive concept defined by the claims below.

The invention claimed is:

1. A method of controlling elevators for evacuating people from a building, in which the power available for the elevator system to use is smaller than in normal operating mode, wherein the method comprises the phases:

the numbers of people to be moved between different floors of the building are monitored;

the floor of the greatest priority is defined;

a free elevator is driven without stopping to the defined floor if the starting of the elevator does not cause exceedance of the power available for use; and a filled elevator at the defined floor is driven to the exit floor of the building if the starting of the elevator does not cause exceedance of the power available for use.

2. Method according to claim 1, wherein the method further comprises the phases:

the numbers of people to be moved in the building are calculated by means of car load weighing devices, call data, detectors situated in the door openings of the elevators and/or the stairways; and the numbers of people on the different floors of the building are estimated on the basis of the flows of people.

3. Method according to claim 2, wherein the method further comprises the phase:

the greatest priority is given to the floor on which most people are estimated to be at the moment of examination.

4. Method according to claim 1, wherein the method further comprises the phase:

the greatest priority is given to the floor on which most calls have been given at the moment of examination.

5. Method according to claim 1, wherein the elevator driven in the method is a shuttle elevator, which travels between the exit floor of the building and the upper lobby floor without stopping at floors between these.

6. Method according to claim 1, wherein the elevator driven in the method is a local elevator, which serves all the floors in the desired floor-to-floor zone.

7. Method according to claim 1, wherein the method further comprises the phases:

the elevator is filled at the floor of the greatest priority; and the elevator is directed without stopping to the exit floor.

8. Method according to claim 1, wherein the method further comprises the phases:

the elevator is partially filled at the floor of the greatest priority;

the elevator is directed to at least one intermediate floor, which is situated between the floor of the greatest priority and the exit floor;

the elevator is filled full at the intermediate floor; and the elevator is directed without stopping to the exit floor.

9. Method according to claim 1, wherein the method further comprises the phases:

priorities are defined for different floors according to how many people are estimated to be awaiting evacuation at each floor; and free elevators are allocated to those floors that have the highest priority such that the input power of the system is as much as possible for use by the elevators without exceeding the upper limit of power consumption.

10. Method according to claim 1, wherein the method further comprises the phases:

the smoke concentration and the temperature of the stairways and the elevator shafts of the building are monitored;

the elevator lobbies, elevators, stairways or other areas of the building in which the smoke concentration or the temperature has exceeded the set threshold value are defined as being dangerous to people;

people are directed to the desired elevator lobby, elevator, other floor, direction or stairway, which has not been defined as dangerous; and the aforementioned free elevator is directed to the floor to which the people have been directed.

11. Method according to claim 10, wherein the method further comprises the phase:

the greatest priority is given to the floor at which the set threshold value is exceeded the most.

12. Method according to claim 10, wherein the method further comprises the phase:

a filled elevator at a defined floor is driven without stopping to an alternative exit floor, if the main exit floor of the building has been defined as dangerous and the alternative exit floor has been defined as non-dangerous.

13. Method according to claim 10, that wherein the method further comprises the phase:

the evacuation mode of the elevator system is activated when the set threshold value is exceeded.

14. Method according to claim 1, wherein the method further comprises the phase:

the evacuation mode of the elevator system is activated manually.

15. Method according to claim 2, wherein the method further comprises the phases:

a traffic profile based on the calculated quantities of traffic is created for each day of the week with the desired time windows, in which the traffic profile contains data about the number of users of the elevators, travelators and stairways; and the traffic situation and the numbers of people on the different floors of the building are forecast based on the traffic profile.

16. Method according to claim 1, wherein the method further comprises the phase:

the elevators are directed to the floors to be evacuated in the sequence of priority such that when one elevator stops at a floor another elevator starts moving.

17. Method according to claim 1, wherein the method further comprises the phase:

a genetic algorithm is used in defining the routing of the elevators.

18. System for evacuating people from a building using the elevators of an elevator system as an aid, in which the power available for the elevator system to use is smaller than in normal operating mode, wherein the system comprises:

a monitoring unit for monitoring the numbers of people to be moved between the different floors of the building;

group control of the elevators for defining the floor of the greatest priority;

group control of the elevators for driving a free elevator to the defined floor without stopping if the starting of the elevator does not cause an exceedance of the power available for use; and group control of the elevators for driving a filled elevator at the defined floor to the exit floor of the building if the starting of the elevator does not cause exceedance of the power available for use.

19. System according to claim 18, wherein the system further comprises:

a monitoring unit for calculating the numbers of people to be moved in the building by means of car load weighing devices, call data, detectors situated in the door openings of the elevators and/or the stairways ; and a monitoring unit for estimating the numbers of people on the different floors of the building on the basis of the flows of people.

20. System according to claim 19, wherein the system further comprises:

group control of the elevators for giving the greatest priority to the floor on which most people are estimated to be at the moment of examination.

21. System according to claim 18, wherein the system further comprises:

group control of the elevators for giving the greatest priority to the floor on which most calls have been given at the moment of examination.

22. System according to claim 18, wherein he driven elevator is a shuttle elevator, which travels between the exit floor and the upper lobby floor without stopping at floors between these.

23. System according to claim 18, wherein the driven elevator is a local elevator, which serves all the floors in the desired floor-to-floor zone.

24. System according to claim 18, wherein the system further comprises:

group control of the elevators allowing the filling of an elevator at the floor of the greatest priority; and group control of the elevators for directing an elevator without stopping to the exit floor.

25. System according to claim 18, wherein the system further comprises:

group control of the elevators allowing the partial filling of an elevator at the floor of the greatest priority;

group control of the elevators for directing an elevator to at least one intermediate floor, which is situated between the floor of the greatest priority and the exit floor;

group control of the elevators allowing the filling of an elevator at the intermediate floor; and group control of the elevators for directing an elevator without stopping to the exit floor.

26. System according to claim 18, wherein the system further comprises:

group control of the elevators for defining priorities for different floors according to how many people are estimated to be awaiting evacuation at each floor; and group control of the elevators for allocating free elevators to those floors that have the highest priority such that the input power of the system is as much as possible for use by the elevators without exceeding the upper limit of power consumption.

27. System according to claim 18, wherein the system further comprises:

smoke detectors and temperature detectors for monitoring the smoke concentration and the temperature of the stairways and elevator shafts of the building;

evacuation management system for defining the elevator lobbies, elevators, stairways or other areas of the building that are dangerous to people, in which the smoke concentration or the temperature has exceeded the set threshold value;

evacuation management system for directing people to the desired elevator lobby, elevator, other floor, direction or stairway, which has not been defined as dangerous; and group control of the elevators for directing the aforementioned free elevator to the floor to which the people have been directed.

28. System according to claim 27, wherein the system further comprises:

group control of the elevators for giving the greatest priority to the floor at which the set threshold value is exceeded the most.

29. System according to claim 27, wherein the system further comprises:

group control of the elevators for driving a filled elevator at a defined floor without stopping to an alternative exit floor, if the main exit floor of the building has been defined as dangerous and if the alternative exit floor has been defined as non-dangerous.

30. System according to claim 27, wherein the system further comprises:

evacuation management system for activating the evacuation mode of the elevator system when the set threshold value is exceeded.

31. System according to claim 18, wherein the system further comprises:

evacuation management system for activating the evacuation mode of the elevator system manually.

32. System according to claim 19, wherein the system further comprises:

traffic forecaster unit for creating a traffic profile on the basis of the calculated amounts of traffic, for each day of the week with the desired time windows, which traffic profile contains data about the number of users of the elevators, travelators and stairways; and traffic forecaster unit for forecasting the traffic situation and the numbers of people on the different floors of the building based on the traffic profile.

33. System according to claim 18, wherein the system further comprises:

group control of the elevators for directing the elevators to the floors to be evacuated in the sequence of priority such that when one elevator stops at a floor another elevator starts moving.

34. System according to claim 18, wherein the group control of the elevators further uses a genetic algorithm in defining the routing of the elevators.

35. A computer program product embodied on a computer-readable medium, for evacuating people from a building using the elevators of an elevator system as an aid, in which the power available for the elevator system to use is smaller than in normal operating mode, wherein the computer program product comprises computer-executable instructions of:

monitoring the numbers of people to be moved between the different floors of a building;

defining the floor of the greatest priority;

driving a free elevator without stopping to the defined floor if the starting of the elevator does not cause exceedance of the power available for use; and driving a filled elevator without stopping to the exit floor of the building if the starting of the elevator does not cause exceedance of the power available for use.

36. The computer program product according to claim 35, wherein the computer program product further comprises computer-executable instructions of calculating the numbers of people to be moved in the building by means of car load weighing devices, call data, detectors situated in the door openings of the elevators and/or the stairways; and estimating the numbers of people on the different floors of the building on the basis of the flows of people.

37. The computer program product according to claim 36, wherein the computer program product further comprises computer-executable instructions of giving the greatest priority to the floor on which most people are estimated to be at the moment of examination.

38. The computer program product according to claim 35, wherein the computer program product further comprises computer-executable instructions of giving the greatest priority to the floor on which most calls have been given at the moment of examination.

39. The computer program product according to claim 35, wherein the elevator driven according to the computer-executable instructions is a shuttle elevator, which travels between the exit floor of the building and the upper lobby floor without stopping at floors between these.

40. The computer program product according to claim 35, wherein the elevator driven according to the computer-executable instructions is a local elevator, which serves all the floors in the desired floor-to-floor zone.

41. The computer program product according to claim 35, wherein the computer program product further comprises computer-executable instructions of filling the elevator full at the floor of the greatest priority; and directing the elevator without stopping to the exit floor.

42. The computer program product according to claim 35, wherein the computer program product further comprises computer-executable instructions of partially filling the elevator at the floor of the greatest priority;

directing the elevator to at least one intermediate floor, which is situated between the floor of the greatest priority and the exit floor;

filling the elevator full at the intermediate floor; and directing the elevator without stopping to the exit floor.

43. The computer program product according to claim 35, wherein the computer program product further comprises computer-executable instructions of defining the priorities for different floors according to how many people are estimated to be awaiting evacuation at each floor; and allocating free elevators to those floors that have the highest priority such that the input power of the system is as much as possible for the elevators to use without exceeding the upper limit of power consumption.

44. The computer program product according to claim 35, wherein the computer program product further comprises computer-executable instructions of monitoring the smoke concentration and the temperature of the stairways and the elevator shafts of the building;

defining the elevator lobbies, elevators, stairways or other areas of the building that are dangerous to people, in which the smoke concentration or the temperature has exceeded the set threshold value;

directing people to the desired elevator lobby, elevator, other floor, direction or stairway, which has not been defined as dangerous; and directing the aforementioned free elevator to the floor to which the people have been directed.

45. The computer program product according to claim 44, wherein the computer program product further comprises computer-executable instructions of giving the greatest priority to the floor at which the set threshold value is exceeded the most.

46. The computer program product according to claim 44, wherein the computer program product further comprises computer-executable instructions of giving the greatest priority to the floor at which the set threshold value is exceeded the most.

47. The computer program product according to claim 44, wherein the computer program product further comprises computer-executable instructions of driving a filled elevator at a defined floor without stopping to an alternative exit floor, if the main exit floor of the building has been defined as dangerous and the alternative exit floor has been defined as non-dangerous.

48. The computer program product according to claim 44, wherein the computer program product further comprises computer-executable instructions of activating the evacuation mode of the elevator system when the set threshold value has been exceeded.

49. The computer program product according to claim 35, wherein the computer program product further comprises computer-executable instructions of activating the evacuation mode of the elevator system manually.

50. The computer program product according to claim 36, wherein the computer program product further comprises computer-executable instructions of creating a traffic profile based on the calculated quantities of traffic for each day of the week with the desired time windows, in which the traffic profile contains data about the number of users of the elevators, travelators and stairways; and forecasting the traffic situation and the numbers of people on the different floors of the building based on the traffic profile.

51. The computer program product according to claim 35, wherein the computer program product further comprises computer-executable instructions of directing the elevators to the floors to be evacuated in the sequence of priority such that when one elevator stops at a floor another elevator starts moving.

52. The computer program product according to claim 35, wherein the computer program product further comprises computer-executable instructions of using a genetic algorithm in defining the routing of the elevators.

* * * * *